US007573324B2

(12) United States Patent
Kuwano

(10) Patent No.: US 7,573,324 B2
(45) Date of Patent: Aug. 11, 2009

(54) REFERENCE VOLTAGE GENERATOR

(75) Inventor: Takeshi Kuwano, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 99 days.

(21) Appl. No.: 11/593,540

(22) Filed: Nov. 7, 2006

(65) Prior Publication Data

US 2007/0103226 A1 May 10, 2007

(30) Foreign Application Priority Data

Nov. 9, 2005 (JP) ..... 2005-324409

(51) Int. Cl.
*G05F 1/10* (2006.01)
*G05F 3/02* (2006.01)

(52) U.S. Cl. ..... 327/540; 327/539; 323/313; 323/315

(58) Field of Classification Search ..... 327/538–542; 323/311–317
See application file for complete search history.

(56) References Cited

U.S. PATENT DOCUMENTS 4,636,710 A * 1/1987 Stanojevic ..... 323/280
5,289,111 A * 2/1994 Tsuji ..... 323/314
5,631,551 A * 5/1997 Scaccianoce et al. ..... 323/313
5,861,771 A * 1/1999 Matsuda et al. ..... 327/540
6,344,770 B1 * 2/2002 Zha et al. ..... 327/539
6,525,596 B2 * 2/2003 Hosono et al. ..... 327/540
6,542,027 B2 * 4/2003 Zha et al. ..... 327/540

FOREIGN PATENT DOCUMENTS

JP 63-266509 11/1988
JP 2003-7837 1/2003

OTHER PUBLICATIONS

Gray et al. "Analysis and Design of Analog Integrated Circuits Fourth Edition." New York: Wiley and Sons, 2001. 122-123.*

* cited by examiner

*Primary Examiner*—Lincoln Donovan
*Assistant Examiner*—Patrick O'Neill
(74) *Attorney, Agent, or Firm*—McGinn IP Law Group, PLLC

(57) ABSTRACT

A reference voltage generator according to an embodiment of the present invention includes: a voltage setting circuit generating a first voltage having a predetermined voltage difference from an output voltage; a voltage buffer receiving the first voltage and outputting a first power supply substantially equal to the first voltage; a voltage clamp circuit operating based on a second power supply and a third power supply; and a band-gap circuit generating the output voltage, the band-gap circuit operating based on the second power supply and the first power supply output from the voltage clamp circuit.

16 Claims, 5 Drawing Sheets

REFERENCE VOLTAGE GENERATOR

BACKGROUND OF THE INVENTION

1. Field of the Invention

The present invention relates to a reference voltage generator, and more particularly to a reference voltage generator generating a reference voltage using a clamp voltage generated with a voltage clamp circuit as a power supply.

2. Description of Related Art

Along with a recent tendency toward reduction in power supply voltage and power consumption of a semiconductor integrated circuit, an influence of a power supply voltage change or temperature change on circuit operations of the semiconductor integrated circuit becomes large. Thus, a high stability against such change has been required of the circuit. As an example of the semiconductor integrated circuit, there is a reference voltage generator. The reference voltage generator generates a reference voltage used for driving the other circuits, and needs to have a higher stability than that of the other circuits.

An example of the reference voltage generator is disclosed in Japanese Unexamined Patent Publication No. 63-266509 (Related Art 1). FIG. 6 shows a reference voltage generator 100 of the Related Art 1. The reference voltage generator 100 of the Related Art 1 generates, at base terminals of reference voltage determining transistors Q103 and Q104, a reference voltage VBG that is derived from Expression 1 based on reference voltage determining transistors Q103 and Q104, and resistors R1 and R2. In Expression 1, a base-emitter voltage of each transistor is represented by Vbe [transistor number].

$$VBG=R1\times 2((Vbe[Q103]-Vbe[Q104])/R2)+Vbe[Q103] \quad (1)$$

The reference voltage becomes an output voltage Vo as a result of enhancing a current power with an output buffer transistor Q105. The output buffer transistor Q105 is diode-connected, and its base terminal is connected with base terminals of the reference voltage determining transistors Q103 and Q104. Further, the reference voltage generator 100 of the Related Art 1 is configured such that level-shift transistors Q107 and Q108 make the collector voltage of the reference voltage determining transistor Q103 equal to the output voltage Vo. Here, provided that a base-emitter voltage of each transistor is represented by Vbe[transistor number], a collector voltage Vc[Q103] of the reference voltage determining transistor Q103 is expressed by Expression 2. Incidentally, base-emitter voltages of the level-shift transistors Q107 and Q108 are at substantially the same level.

$$Vc[Q103]=Vo-Vbe[Q107]+Vbe[Q108]\cong Vo \quad (2)$$

Through the above operations, the reference voltage generator 100 of the Related Art 1 makes a collector voltage of the reference voltage determining transistor Q103 substantially equal to a collector voltage of the output buffer transistor Q105 to thereby suppress the Early effect of the transistors regardless of the output voltage Vo and suppress variations in output voltage Vo.

However, the collector voltage Vc[Q104] of the reference voltage determining transistor Q104 of the Related Art 1 is derived from Expression 3 based on a power supply voltage VCC and a base-emitter voltage Vbe[Q102] of the transistor Q102.

$$Vc[Q104]=VCC-Vbe[Q102] \quad (3)$$

As apparent from Expressions 2 and 3, if the power supply voltage VCC is changed, a rate of change of Vc[Q104] is different from that of Vc[Q103].

Further, a base-emitter voltage Vbe of the transistor is generally expressed by Expression 4.

$$Vbe=(kT/q)ln(1+Vce/Va)Ic/Is \quad (b\ 4)$$

where k represents Boltzmann constant, T represents an absolute temperature, q represents a charge quantity, Vce represents a collector-emitter voltage of a transistor, Va represents the Early voltage of a transistor, Ic represents a collector current of a transistor, and Is represents a reverse saturation current of a transistor.

As understood from the above description, in the reference voltage generator 100 of the Related Art 1, if the power supply voltage VCC is changed, Vc[Q103] and Vc[Q104] are changed at different rates, so Vce derived from Expression 4 differs between the reference voltage determining transistors Q103 and Q104. A change rate of Vbe differs between the reference voltage determining transistors Q103 and Q104, so VBG derived from Expression 1 is changed.

In order to solve the above problems, Japanese Unexamined Patent Publication No. 2003-7837 (Related Art 2) discloses a technique of stabilizing a power supply voltage of the reference voltage generator. FIG. 7 shows a reference voltage generator 200 of the Related Art 2. As shown in FIG. 7, the reference voltage generator 200 of the Related Art 2 generates a voltage VCC2 that less varies, based on a power supply voltage VCC1 that largely varies. A band-gap circuit 201 generates a reference voltage Vref with the voltage VCC2 used as a power supply.

That is, the reference voltage generator 200 of the Related Art 2 generates the voltage VCC2 that less varies and then generates a reference voltage Vref with the voltage VCC2 used as a power supply to suppress variations in reference voltage Vref relative to the power supply voltage change.

The reference voltage generator of the Related Art 1 has a problem in that the output voltage change relative to the power supply voltage change increases. In the Related Art 2, the regulator 202 is provided to suppress variations in power supply voltage for the band-gap circuit 201, and the regulator 202 has an operational amplifier. Thus, the Related Art 2 has a problem in terms of a performance for realizing a low-voltage operation or low power consumption. For example, the power supply voltage VCC2 necessary for the band-gap circuit 201 to output a desired reference voltage Vref is about Vref+1.5 V, and the power supply voltage VCC1 of the regulator 202 necessary for generating the power supply voltage VCC2 is about VCC2+1.5 V. Therefore, the reference voltage generator 200 of the Related Art 2 should set the power supply voltage of about Vref+3.0 V for obtaining the reference voltage Vref, so a low-voltage operation is difficult.

SUMMARY OF THE INVENTION

A reference voltage generator according to an aspect of the present invention includes: a voltage setting circuit generating a first voltage having a predetermined voltage difference from an output voltage; a voltage buffer receiving the first voltage and outputting a first power supply substantially equal to the first voltage; a voltage clamp circuit operating based on a second power supply and a third power supply; and a band-gap circuit generating the output voltage, the band-gap circuit operating based on the second power supply and the first power supply output from the voltage clamp circuit.

According to the reference voltage generator of the present invention, even if the third power supply (for example, power supply voltage) is changed, the voltage clamp circuit generates a first power supply (for example, a voltage of a node B) based on an output voltage that less varies than the power supply voltage, and drives the band-gap circuit using the voltage of the node B. That is, the band-gap circuit is driven based on the voltage of the node B not directly influenced by the change in power supply voltage, whereby the band-gap circuit can generate an output voltage independently of the change in power supply voltage. Hence, according to the reference voltage generator of the present invention, an output voltage that is little influenced by a change in power supply voltage can be generated.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposed.

First Embodiment

Figure 1:
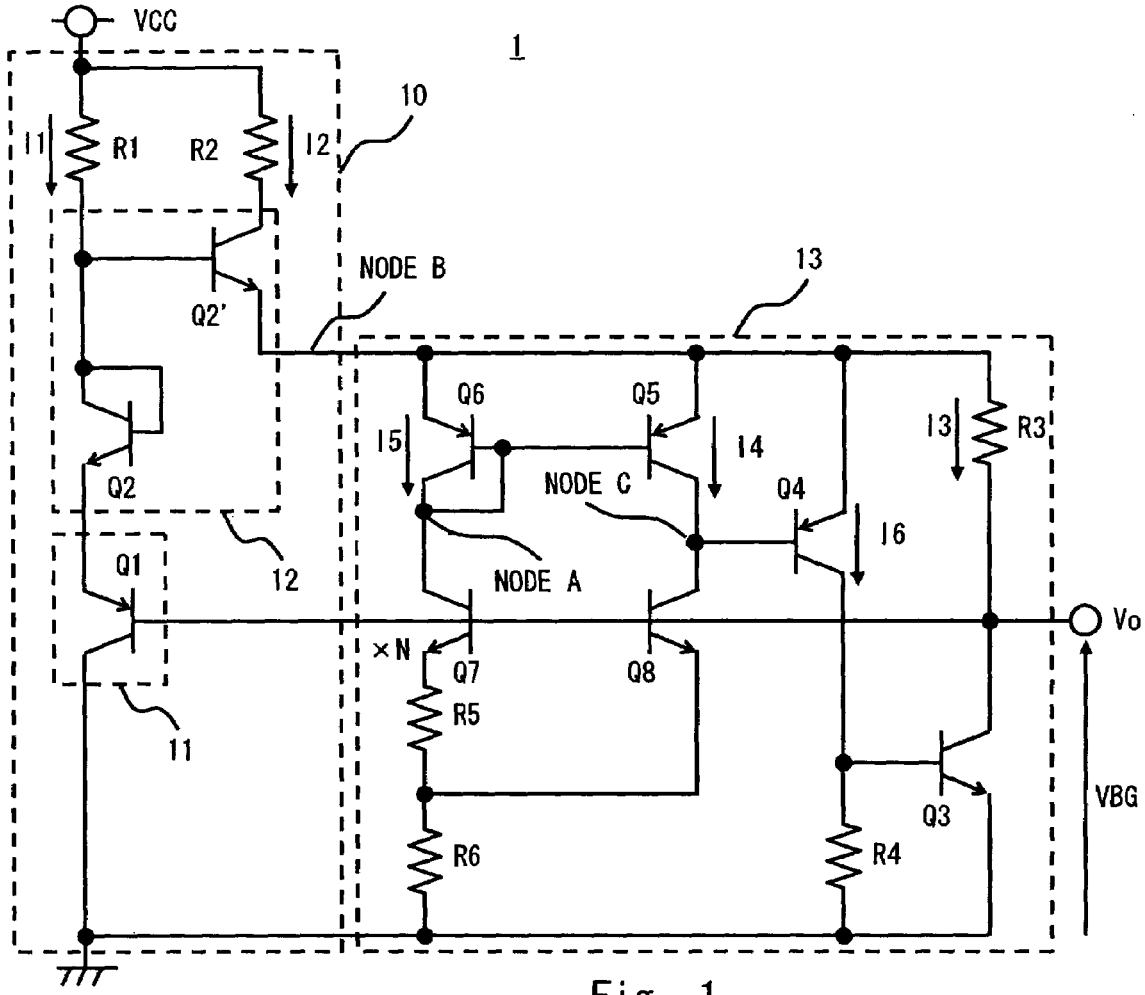
FIG. 1 is a circuit diagram of a reference voltage generator according to a first embodiment of the present invention.

Hereinafter, embodiments of the present invention are described with reference to the accompanying drawings. FIG. 1 is a circuit diagram of a reference voltage generator 1 according to a first embodiment of the present invention. The reference voltage generator 1 includes a voltage clamp circuit 10 and a band-gap circuit 13. The reference voltage generator 1 drives the band-gap circuit 13 using a voltage generated by the voltage clamp circuit 10 based on an output voltage of the band-gap circuit 13 as a power supply. Incidentally, in the following description, a control terminal, a first terminal, and a second terminal of a transistor are referred to as a base, an emitter, and a collector.

The voltage clamp circuit 10 includes a voltage setting circuit 11, a voltage buffer 12, a current setting element (for example, a resistor R1), and a resistor R2. The voltage clamp circuit 10 operates based on a second power supply (for example, a ground voltage) and a third power supply (for example, a power supply voltage VCC). The voltage clamp circuit 10 generates a voltage of a first power supply (for example, a node B) having a predetermined difference from an output voltage of the band-gap circuit 13.

The voltage setting circuit 11 includes a first transistor (for example, a PNP transistor Q1). The PNP transistor Q1 has a base applied with an output voltage Vo and a collector set at a ground voltage. At its emitter, a first voltage having a predetermined voltage difference from the output voltage Vo is output. The first voltage is, for example, a threshold voltage (for example, a base-emitter voltage Vbe) of a PNP transistor.

The voltage buffer 12 includes a second transistor (for example, an NPN transistor Q2) and a third transistor (for example, an NPN transistor Q2'). The voltage buffer 12 is applied with the first voltage output from the voltage setting circuit 11 to output a voltage the level of which is substantially the same as the first voltage. The NPN transistor Q2 is diode-connected in such a way that a base and a collector are connected together, and an emitter is connected with the emitter of the PNP transistor Q1 to receive the first voltage. Further, the collector of the NPN transistor Q2 is connected with one terminal of the current setting element (for example, the resistor R1). The other terminal of the resistor R1 is connected to the power supply voltage VCC.

Further, a line connecting between the resistor R1 and the collector of the NPN transistor Q2 is connected with the base of the NPN transistor Q2'. The resistor R2 is connected between the collector of the NPN transistor Q2' and the power supply voltage VCC. The emitter of the NPN transistor Q2' is an output terminal of the voltage clamp circuit 10, and an output voltage is supplied as a power supply to the band-gap circuit 13.

Incidentally, in this embodiment, the NPN transistor Q2 is diode-connected when in use, but diode elements may be used instead. As described above, the voltage clamp circuit 10 clamps the output voltage of the band-gap circuit 13 to supply the clamped voltage as a power supply to the band-gap circuit 13.

The band-gap circuit 13 includes NPN transistors Q3, Q7, and Q8, PNP transistors Q4, Q5, and Q6, and resistors R3, R4, R5, and R6. The band-gap circuit 13 operates based on the first power supply (for example, the node B) and the second power supply (for example, the ground voltage). Further, the band-gap circuit 13 includes fourth and fifth transistors (for example, NPN transistors Q7 and Q8). Base terminals of the NPN transistors Q7 and Q8 are connected together, and at the base terminals, an output voltage is generated. The collector voltage of each of the NPN transistors Q7 and Q8 is set by first and second voltage setting circuits (for example, PNP transistors Q6 and Q4) connected with the first power supply (for example, the node B). The collector voltages of the NPN transistors Q7 and Q8 set by the PNP transistors Q6 and Q4 are determined to be substantially at the same level, for example, determined such that a voltage difference of the node B corresponds to a threshold voltage (for example, a base-emitter voltage Vbe) of the PNP transistor.

The connection of the band-gap circuit 13 is described in detail next. The PNP transistors Q5 and Q6 constitute a current mirror circuit with their base terminals connected together. Emitter terminals of the PNP transistors Q5 and Q6 are connected with the node B. Further, a base and collector of the PNP transistor Q6 are connected.

Base terminals of the NPN transistors Q7 and Q8 are connected with each other. A collector of the NPN transistor Q7 is connected with a collector of the PNP transistor Q6, and a node therebetween is a first node (node A). A collector of the NPN transistor Q8 is connected with a collector of the PNP transistor Q5, and a node therebetween is a second node (node C). The resistors R5 and R6 are connected in series between an emitter of the NPN transistor Q7 and the ground voltage. An emitter of the NPN transistor Q8 is connected with a node between the resistor R5 and the resistor R6. In this example, an emitter area of the NPN transistor Q7 is N times larger than an emitter area of the NPN transistor Q8.

An emitter of the PNP transistor Q4 is connected with the node B, and a base thereof is connected with the node C. The resistor R4 is connected between the collector of the PNP transistor Q4 and the ground voltage. An emitter of the NPN transistor Q3 is connected with the ground voltage, and a base is connected between a collector of the PNP transistor and the resistor R4. The resistor R3 is connected between the collector of the NPN transistor Q3 and the node B. A node between the collector of the NPN transistor Q3 and the resistor R3 is the output terminal Vo, and the output terminal Vo is connected with base terminals of the NPN transistors Q7 and Q8, and the PNP transistor Q1.

Although not shown in FIG. 1, it is preferred to connect a starting circuit between the base of the NPN transistors Q7 and Q8 and the power supply voltage VCC.

Operations of the reference voltage generator 1 of the first embodiment are described next. Here, the base-emitter voltage Vbe of the transistor used in the reference voltage generator 1 is derived from Expression 5.

$$Vbe=(kT/q)ln(1+Vce/Va)N\cdot Ic/Is \quad (5)$$

In Expression 5, represents Boltzmann constant, T represents an absolute temperature, q represents a charge quantity, Vce represents a collector-emitter voltage of the transistor, Va represents the Early voltage of the transistor, Ic represents a collector current of the transistor, Is represents a reverse saturation current of the transistor, and N represents an emitter area ratio of the transistor. In this embodiment, an emitter area of the NPN transistor Q7 is set N times larger than an emitter area of the other transistor, so the value of N of the other transistors than the NPN transistor Q7 is 1.

In the reference voltage generator 1, the band-gap voltage VBG is generated with the band-gap circuit 13, and the voltage is output from the output terminal Vo. The band-gap voltage VBG is described next. The band-gap voltage VBG is determined by the NPN transistors Q7 and Q8, and the resistors R5 and R6. A difference between the base-emitter voltage Vbe[Q7] of the NPN transistor Q7 and the base-emitter voltage Vbe[Q8] of the NPN transistor is divided by the resistor R5 to thereby determine a current I5. Further, the PNP transistors Q6 and Q5 constitute a current mirror, so a current I4 substantially equal to the current I5 flows through the PNP transistor Q5 as well. The current I4 is supplied to the NPN transistor Q8. That is, substantially equal currents I4 and I5 are supplied to the NPN transistors Q8 and Q7. Thus, the band-gap voltage VBG is derived from Expression 6.

$$VBG=2*R6((Vbe[Q8]-Vbe[Q7])/R5)+Vbe[Q8] \quad (6)$$

The generated band-gap voltage VBG is output from the output terminal Vo after its current power is enhanced by the PNP transistor Q4, the NPN transistor Q3, and the resistors R3 and R4.

Further, in the reference voltage generator 1, the voltage clamp circuit 10 generates a voltage VB of the node B, the voltage of which is higher than the output voltage VBG by a predetermined voltage, to supply the voltage VB to the band-gap circuit 13 as a power supply. In this embodiment, the PNP transistors Q1 and Q6 are set to have substantially the same characteristics, and the NPN transistor Q2 and the NPN transistor Q2' are set to have substantially the same characteristics. Hence, the voltage VB of the node B can be derived from Expression 7 if the base-emitter voltage of the transistor Q2 is represented by Vbe[Q2].

$$\begin{aligned} VB &= VBG + Vbe[Q1] + Vbe[Q2] - Vbe[Q2'] \\ &= VBG + Vbe[Q1] \end{aligned} \quad (7)$$

In this example, the resistor R1 is used to set a current I1 consumed by the voltage clamp circuit 10, and functions as the current setting element. The resistor R2 is used to set a current I2 consumed by the band-gap circuit 13.

The reference voltage generator 1 of the first embodiment drives the band-gap circuit 13 with the voltage VB generated by the voltage clamp circuit 10 as a power supply based on the output voltage Vo of the band-gap circuit 13. Hence, even if the power supply voltage VCC varies, as understood from Expression 7, the voltage VB as the power supply for the band-gap circuit 13 is not influenced by the variations in power supply voltage VCC.

Assuming that the power supply voltage VCC varies, when the current I1 is changed, the base-emitter voltage Vbe[Q1] of the PNP transistor Q1 and the base-emitter voltage Vbe[Q2] of the transistor Q2 would be changed. However, as understood from Expression 5, the collector current Ic of the transistor varies relative to the voltage Vbe in logarithmic proportion. Thus, even if the collector current Ic of the transistor is changed, the change has little influence on the voltage Vbe. As understood from this, the voltage VB generated by the voltage clamp circuit 10 is stabilized with respect to a change in current I1 due to the change in power supply voltage VCC.

The thus-generated voltage VB is used as a power supply, and the voltage VA of the node A on the collector side of the NPN transistor Q7 of the band-gap circuit 13 and the voltage VC of the node C on the collector side of the NPN transistor Q8 are expressed by Expression 8 and Expression 9.

$$VA=VBG+Vbe[Q1]-Vbe[Q6] \quad (8)$$

$$VC=VBG+Vbe[Q1]-Vbe[Q4] \quad (9)$$

Here, in this embodiment, for example, the PNP transistor Q4 and the PNP transistor Q1 have substantially the same shape, and the collector current I6 of the PNP transistor that is calculated by dividing the base-emitter voltage Vbe[Q3] of the NPN transistor Q3 by the resistor R4 is set such that I6=I5, so Vbe[Q6]=Vbe[Q4]. Hence, the voltage VA and the voltage VC can be assumed to be substantially equal.

As described above, according to the band-gap circuit 13 of the first embodiment, the PNP transistors Q1, Q6, and Q4 have substantially the same characteristics, and thereby the voltage of the collector-side node of the NPN transistors Q7 and Q8 can be set such that VA=VC independently of the change in voltage VCC. As a result, base-collector voltages of two transistors become substantially constant, so collector-emitter voltage differences of two transistors become substantially constant. Hence, an influence of the Early effect on two transistors is suppressed. This stabilizes a voltage relation of terminals of the NPN transistors Q7 and Q8, and thus, more stable band-gap voltage VBG can be generated.

Since the output voltage VBG of the band-gap circuit 13 is stabilized, a current I3 flowing through the resistor R3 of the band-gap circuit is stabilized. As a result, the current I2 flowing through the NPN transistor Q2' of the voltage clamp circuit 10 is stabilized. This suppresses a change in collector current of the NPN transistor Q2', and thus the base-emitter voltage Vbe [Q2'] of the NPN transistor Q2' is stabilized, and the voltage VB can be further stabilized.

Further, in this embodiment, the base-emitter voltage Vbe [Q2'] of the NPN transistor Q2' and the base-emitter voltage Vbe[Q2] of the transistor Q2 are set to have substantially the same characteristics. If Vbe[Q2] and Vbe [Q2'] are changed at the same rate with respect to the temperature change, for example, the voltage VB can be set such that VB=Vo+Vbe [Q1] independently of ambient temperature.

As described above, according to the reference voltage generator 1 of the first embodiment, the voltage VB that is stable against the change in power supply voltage VCC is generated, and the band-gap voltage VBG is generated based on the voltage VB to thereby attain the output voltage Vo (VBG) that is little influenced by the change in power supply voltage VCC. The requisite minimum power supply voltage for operations of the reference voltage generator 1 is represented as follows: VCC=VBG+Vbe[Q1]+Vbe[Q2']. For example, the generator can operate with the voltage VCC=VBG+1.2 V, and can operate with a lower voltage than that of the Related Art 2. In addition, the voltage clamp circuit 10 of the reference voltage generator 1 can be composed of 5 elements as described above. In the Related Art 2, the operational amplifier requires about 50 elements. In contrast, in this embodiment, the power supply of the band-gap circuit 13 can be stabilized with a very small circuit.

Further, the PNP transistors Q1, Q4, and Q6 have substantially the same characteristics, and variations in voltage of each element become the same with respect to product variations and a temperature change. Further, the NPN transistor Q2 and the NPN transistor Q2' have substantially the same characteristics, so the variations in voltage of each element become the same with respect to product variations and a temperature change. That is, the characteristics of these elements are adjusted, and thus the variations of the elements can be cancelled out to further stabilize the circuit operations.

Figure 2:
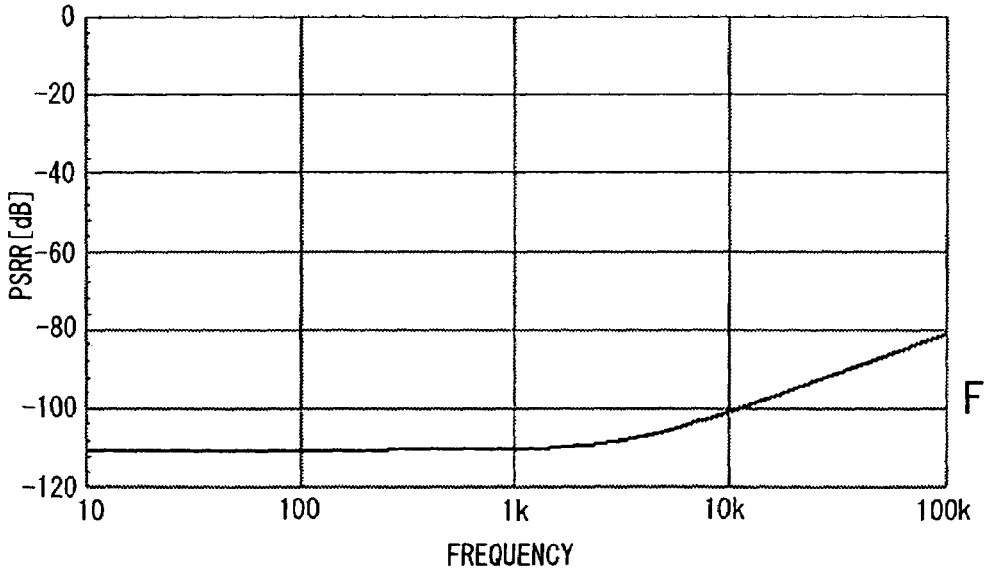
FIG. 2 shows PSRR characteristics of the reference voltage generator of the first embodiment.

FIG. 2 shows an example of how the output voltage is changed with respect to the change in power supply voltage VCC of the reference voltage generator 1 of this embodiment. In FIG. 2, the vertical axis represents PSRR (Power Supply Ripple Rejection) indicating a ratio of the output voltage change to the power supply voltage VCC change, and the horizontal axis represents a ripple frequency. In general, the required PSRR is lower than −100 dB on a low-frequency side. As apparent from FIG. 2, the reference voltage generator 1 of this embodiment has a ripple noise level characteristic of −100 dB or less within a ripple frequency range of 10 kHz or less, and the ripple noise level characteristic is higher than a general, reference ripple noise level.

Second Embodiment

Figure 3:
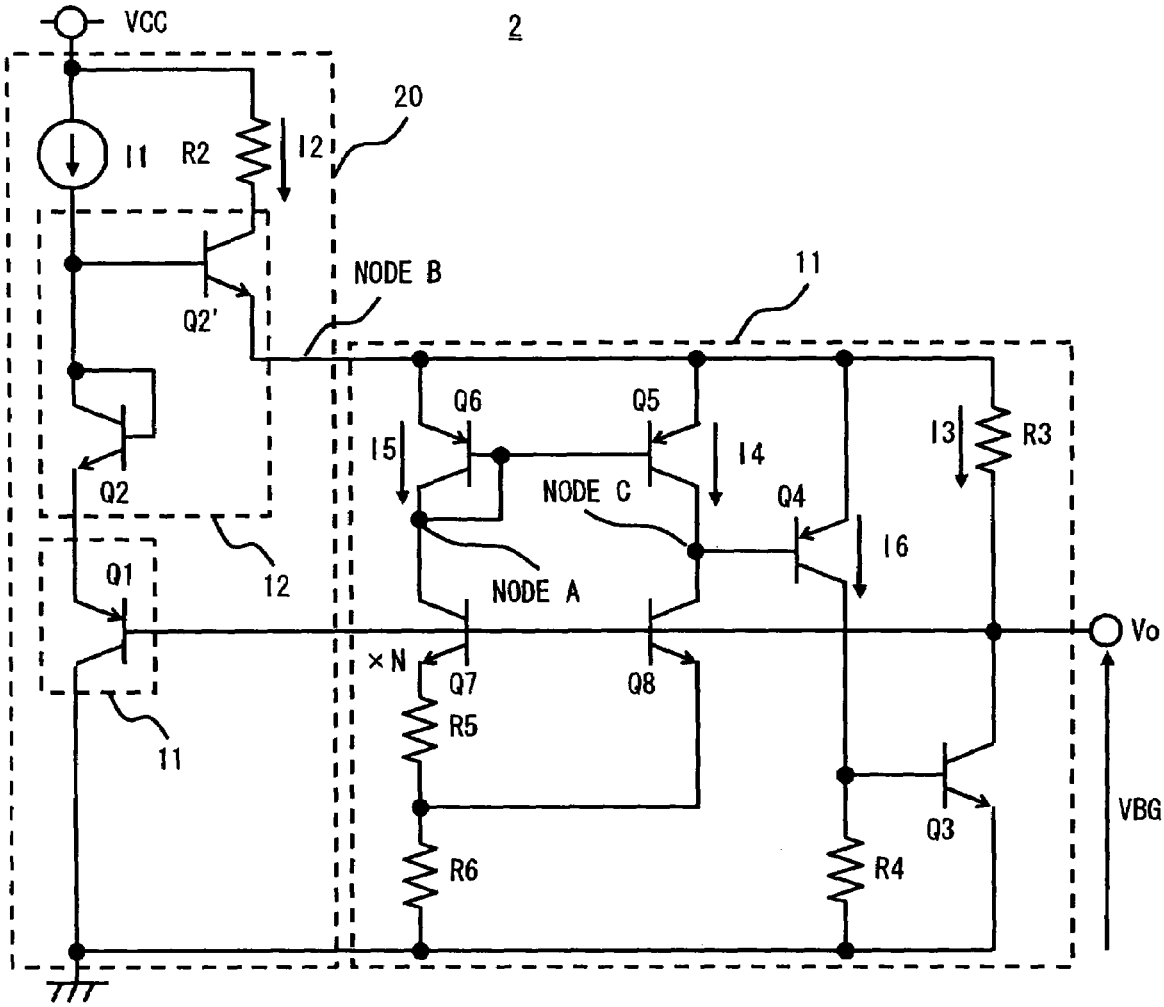
FIG. 3 is a circuit diagram of a reference voltage generator according to a second embodiment of the present invention.

FIG. 3 shows a reference voltage generator 2 according to a second embodiment of the present invention. The reference voltage generator 2 of the second embodiment includes a voltage clamp circuit 20 where a current source I1 is provided in place of the resistor R1 of the voltage clamp circuit 10 which sets the operational current I1 of the reference voltage generator 1 of the first embodiment.

An output resistance of the current source I1 is very high, so even if the power supply voltage VCC varies, an output current value is little changed. Therefore, in the reference voltage generator 1 of the first embodiment, the current I1 is changed due to the change in power supply voltage VCC. In contrast thereto, in the reference voltage generator 2 of the second embodiment, even if the power supply voltage VCC varies, a value of the current I1 is little changed.

That is, the voltage VB generated in the voltage clamp circuit 20 of the second embodiment is more stabilized than the voltage VB generated in the voltage clamp circuit 10 of the first embodiment. The thus-stabilized voltage VB is used, and thus the reference voltage generator 2 of the second embodiment attains higher PSRR characteristics than the reference voltage generator 1 of the first embodiment.

Figure 4:
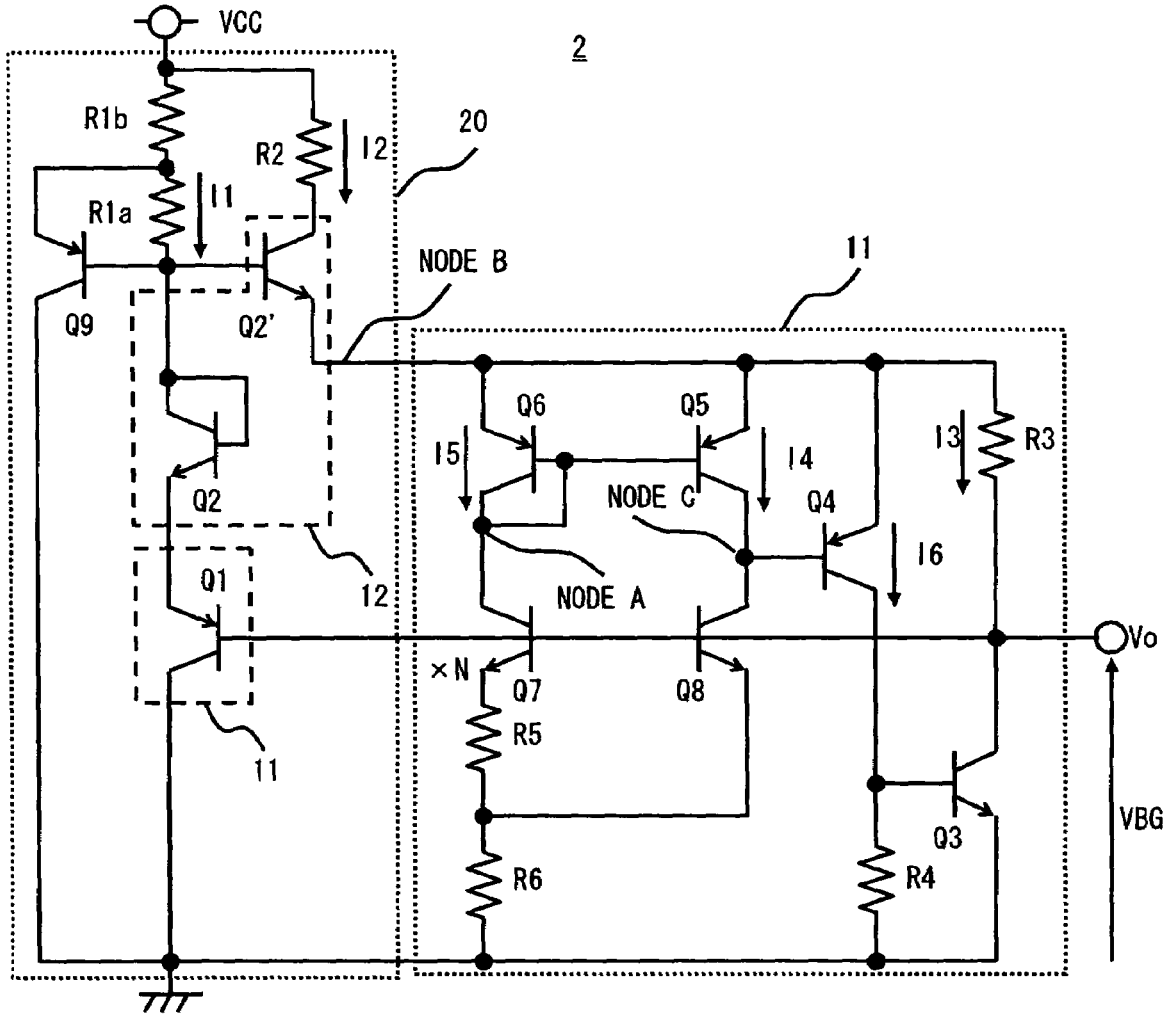
FIG. 4 shows a specific circuit example of the reference voltage generator of the second embodiment.
Figure 5:
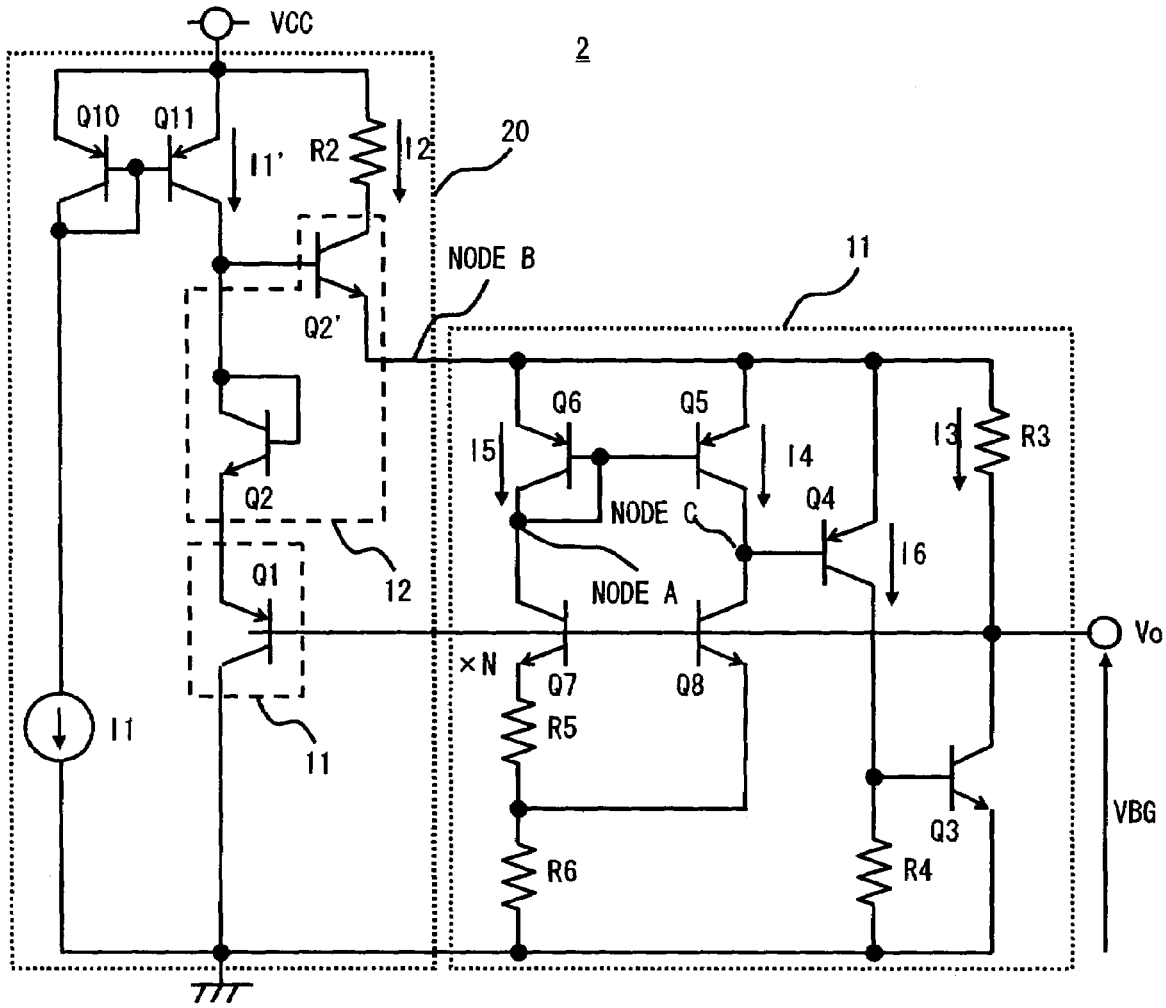
FIG. 5 shows another specific circuit example of the reference voltage generator of the second embodiment.
Figure 6:
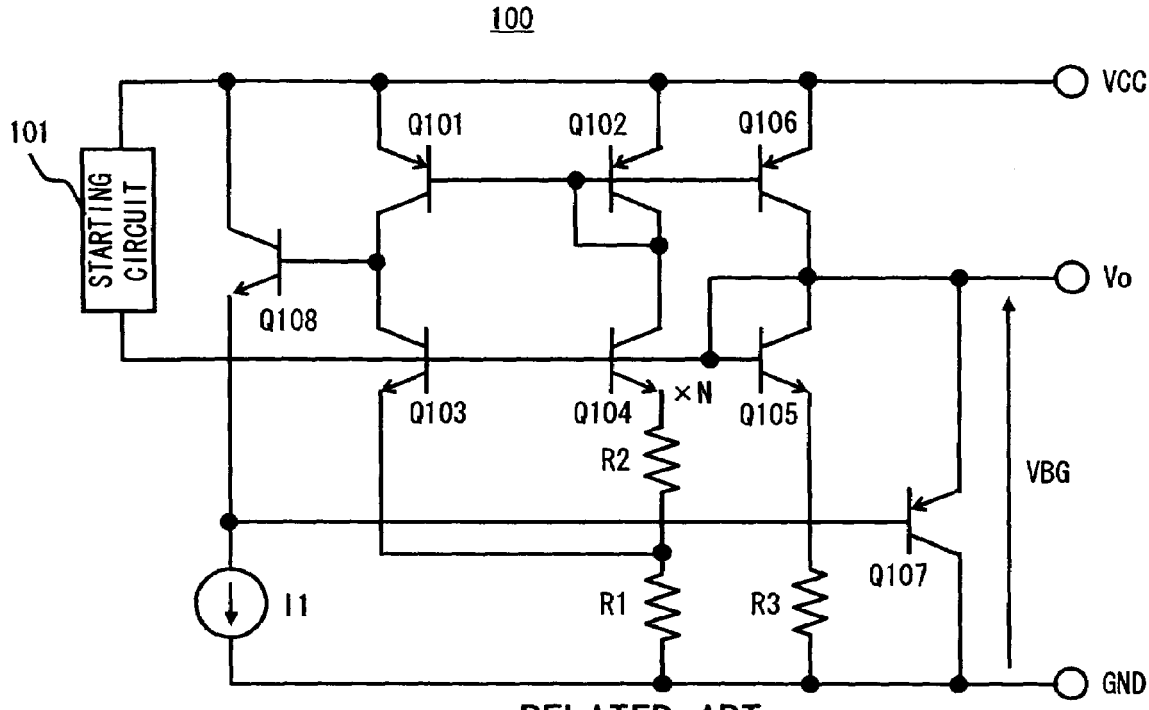
RELATED ART Fig. 6
FIG. 6 is a circuit diagram of a reference voltage generator of the Related Art 1.
Figure 7:
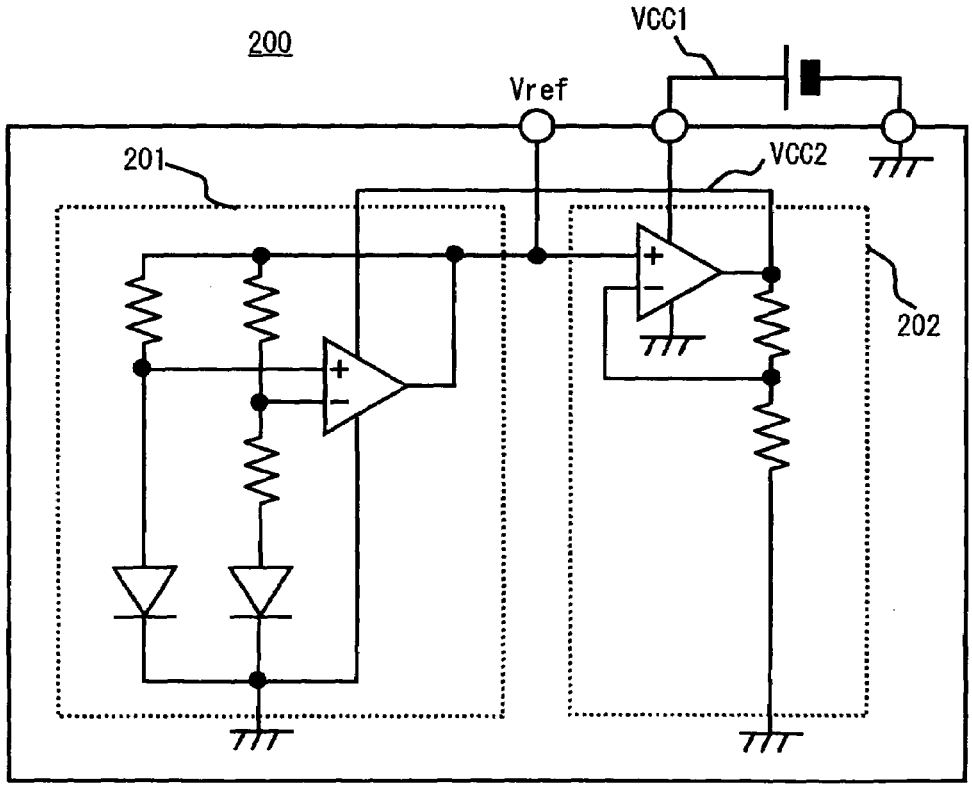
RELATED ART Fig. 7
FIG. 7 is a circuit diagram of a reference voltage generator of the Related Art 2.

FIGS. 4 and 5 are circuit diagrams of a specific example of the current source I1 of FIG. 3. In the voltage clamp circuit 20 of FIG. 4, resistors R1*a* and R1*b* are series-connected between the power supply voltage VCC and the base of the NPN transistor Q2'. Further, the voltage clamp circuit 20 includes a PNP transistor Q9. An emitter of the PNP transistor Q9 is connected with a node between the resistors R1*a* and R1*b*, and its base is connected with a base of the NPN transistor Q2'. Further, the collector of the PNP transistor Q9 is connected with the ground voltage. Thus, the current I1 is set such that I1=Vbe[Q9]/R1*b*.

In the voltage clamp circuit 20 of FIG. 5, for example, a band-gap current source is used as the current source I1, and the current I1 is inverted into a current I1' by means of a current mirror composed of the PNP transistors Q10 and Q11. This current source I1' serves as a current source of the voltage clamp circuit 20.

The number of elements of the voltage clamp circuit 20 of FIGS. 4 and 5 is larger than that of the voltage clamp circuit 10 of the first embodiment. However, it is possible to generate a more stable voltage VB than the voltage of the voltage clamp circuit 10 of the first embodiment by using these circuits.

Incidentally, as another embodiment of the present invention, a resistor may be inserted to the emitter of the transistors constituting the current mirror to suppress the Early effect relative to the current mirror circuit. Further, the band-gap circuit is not limited to the circuit of the above embodiments, and can be appropriately modified, for example, modified to a band-gap circuit by use of PNP transistors.

It is apparent that the present invention is not limited to the above embodiment that may be modified and changed without departing from the scope and spirit of the invention.

What is claimed is:

1. A reference voltage generator, comprising:

a voltage clamp circuit operating based on a second power supply and a third power supply; and a band-gap circuit responding to a first power supply and the second power supply to generate an output voltage, wherein the voltage clamp circuit includes:

a voltage setting circuit generating a first voltage having a predetermined voltage difference from the output voltage; and a voltage buffer receiving the first voltage and outputting the first power supply substantially equal to the first voltage, and wherein the voltage setting circuit includes a first transistor having a control terminal applied with the output voltage, and having a first terminal where the first voltage is generated.

2. The reference voltage generator according to claim 1, wherein the voltage clamp circuit includes a current setting element connected between the voltage buffer and the third power supply, and setting an amount of current to be supplied to the voltage setting circuit and the voltage buffer.

3. The reference voltage generator according to claim 1, wherein the voltage buffer includes a second transistor having a first terminal applied with the first voltage, and having a control terminal and a second terminal that are connected together, and includes a third transistor having a control terminal connected with the second terminal of the second transistor, and having a first terminal from which the first power supply is output.

4. The reference voltage generator according to claim 3, wherein a voltage difference between the control terminal and the first terminal of the second transistor and a voltage difference between the control terminal and the first terminal of the third transistor are changed at substantially a same rate with respect to a temperature change and are substantially equal to each other.

5. The reference voltage generator according to claim 3, wherein said third transistor is connected with said second transistor only by said control terminal of said third transistor and at most one of said first and second terminals of said second transistor.

6. The reference voltage generator according to claim 1, wherein the band-gap circuit includes:

fourth and fifth transistors having control terminals connected with each other, at which the output voltage is generated;

a first voltage setting element connected between a second terminal of the fourth transistor and the first power supply, and setting a first voltage difference between the first power supply and the second terminal of the fourth transistor; and a second voltage setting element connected between a second terminal of the fifth transistor and the first power supply, and setting a second voltage difference between the first power supply and the second terminal of the fifth transistor to be substantially equal to the first voltage difference.

7. The reference voltage generator according to claim 6, wherein a voltage difference between the first voltage and the output voltage is substantially equal to the first and second voltage differences.

8. The reference voltage generator according to claim 1, wherein a voltage difference between the first voltage and the output voltage is substantially equal to a voltage difference between the first power supply and the output voltage.

9. The reference voltage generator according to claim 1, wherein said voltage buffer receives the first voltage through a first connection and outputs the first power supply substantially equal to the first voltage through a second connection different from said first connection.

10. The reference voltage generator according to claim 1, wherein said output voltage of said band-gap circuit comprises an output voltage of said reference voltage generator.

11. A reference voltage generator composed of a plurality of transistors each having a control terminal, a first terminal, and a second terminal, comprising:

a voltage clamp circuit operating based on a second power supply and a third power supply; and a band-gap circuit responding to a first power supply and the second power supply to generate an output voltage, wherein the voltage clamp circuit includes:

a first transistor having a control terminal applied with the output voltage;

a second transistor having a first terminal connected with a first terminal of the first transistor, and having a control terminal and a second terminal connected together; and a third transistor having a control terminal connected with the second terminal of the second transistor, and having a first terminal at which the first power supply is generated.

12. The reference voltage generator according to claim 11, wherein the voltage clamp circuit includes a current setting element connected between the second terminal of the second transistor and the third power supply, and setting an amount of current to be supplied to the first transistor and the second transistor.

13. The reference voltage generator according to claim 11, wherein a voltage difference between the control terminal and the first terminal of the second transistor and a voltage difference between the control terminal and the first terminal of the third transistor are changed at substantially a same rate with respect to a temperature change and are substantially equal to each other.

14. The reference voltage generator according to claim 11, wherein the band-gap circuit includes:

fourth and fifth transistors having contra!terminals connected with each other, at which the output voltage is generated;

a first voltage setting element connected between a second terminal of the fourth transistor and the first power supply, and setting a first voltage difference between the first power supply and the second terminal of the fourth transistor; and a second voltage setting element connected between a second terminal of the fifth transistor and the first power supply, and setting a second voltage difference between the first power supply and the second terminal of the fifth transistor to be substantially equal to the first voltage difference.

15. The reference voltage generator according to claim 14, wherein a voltage difference between the control terminal and the first terminal of the first transistor is substantially equal to the first and second voltage differences.

16. The reference voltage generator according to claim 11, wherein a voltage difference between the control terminal and the first terminal of the first transistor is substantially equal to a voltage difference between the first power supply and output voltages.

* * * * *